United States Patent [19]

Sogawa et al.

[11] Patent Number: 4,462,741

[45] Date of Patent: Jul. 31, 1984

[54] PRESSING MACHINE WITH A BUILT-IN ROBOT

[75] Inventors: Atushi Sogawa; Seiji Mukumoto, both of Tokushima, Japan

[73] Assignee: Nagao Iron Works Ltd., Tokushima, Japan

[21] Appl. No.: 387,908

[22] Filed: Jun. 14, 1982

[30] Foreign Application Priority Data

Apr. 10, 1982 [JP] Japan ..... 57-60160

[51] Int. Cl.[3] ..... B65H 5/10

[52] U.S. Cl. ..... 414/225; 72/419; 72/422; 74/53; 100/215; 414/752; 414/72; 414/32

[58] Field of Search ..... 414/222, 225, 749–753, 414/32, 72, 74; 72/419, 421, 422; 74/53, 54; 100/215, 218

[56] References Cited

U.S. PATENT DOCUMENTS

| | | | |
|---|---|---|---|
| 3,364,723 | 1/1968 | Gartside | 72/421 X |
| 3,881,362 | 5/1975 | Beezer | 74/53 |
| 4,361,413 | 11/1982 | Toda | 414/225 X |
| 4,370,092 | 1/1983 | Healy | 414/752 |

FOREIGN PATENT DOCUMENTS

| | | | |
|---|---|---|---|
| 2555205 | 6/1977 | Fed. Rep. of Germany | 74/421 |

*Primary Examiner*—Robert J. Spar
*Assistant Examiner*—Donald W. Underwood
*Attorney, Agent, or Firm*—Flynn, Thiel, Boutell & Tanis

[57] ABSTRACT

A crank type, C-frame pressing machine in which a robot for loading a workpiece and unloading a fabricated product is built-in within a space enclosed by the frame behind a fabricating station, with a pair of chucks on a feed bar extending across the front of the machine. The robot comprises a lift cam and a feed cam. Swing arms are provided each of which abuts the periphery of each of the cams, which arms are adapted to be actuated in conformity with the cam profiles. An actuation system is operatively connected to the swing arms and serves to transmit the actuation of swing arms to the feed bar. The actuation system includes a lift arm operatively engaging the swing arm for the lift cam and a drive arm operatively engaging the swing arm for the feed cam, the lift arm and the drive arm being constructed so that both are coupled to the feed bar, the former being movable vertically and the latter being movable vertically and laterally, to thereby transmit the vertical and lateral movements to the feed bar.

2 Claims, 8 Drawing Figures

PRESSING MACHINE WITH A BUILT-IN ROBOT

FIELD OF THE INVENTION

This invention relates to a compact pressing machine with a built-in robot for loading a workpiece for fabricating and unloading a fabricated product within its inner space, and more particularly, to a pressing machine for a fabrication process.

BACKGROUND OF THE INVENTION

It is well-known that in order to attain the automation and energy-saving of a press fabricating operation, robot systems have recently been adopted in a modernized press fabricating system.

In general, a robot system comprises a feed bar provided with chucks, a lift unit, a vacuum pump and a vacuum unit and is assembled with a variety of attachement devices, to thereby integrally conduct a centralized robot operation for pressing work.

In a robot mechanism for performing work transference operations, which at present is the most common use thereof, the major elements including a driving device and an actuating mechanism are positioned on both lateral sides of the press machine, whereby a feed bar and chucks projecting from it are movable laterally relative to the press machine so as to load a workpiece to be fabricated and unload a fabricated product.

The robot mechanism of the type including a lateral feeding mechanism, however, has the drawback that the major elements are positioned more remote from the press machine than a case containing workpiece materials and a case containing fabricated products both of which are positioned on both sides of the press machine, and accordingly, a wide space is required for the installation of the whole assembly.

Stated another way, this mechanism may assist greatly in the automation and energy-saving, but is inconvenient to handle or operate and is seriously defective in respect of efficient utilization of the workshop space.

In view of the situations and the current trend set forth above, this invention has been accomplished by finding a compact robot whose major elements, including a drive means, are accommodated in a built-in manner within a space behind a fabricating station of a pressing machine.

SUMMARY OF THE INVENTION

This invention relates to a crank pressing machine having a frame and a built-in robot for loading a workpiece to be fabricated and unloading a fabricated product. The robot is disposed in a space enclosed by the frame behind a fabricating station. A pair of spaced material engaging devices are provided on a feed bar extending across the front of said machine. The feed bar is supported for both vertical and lateral movement. A drive shaft drivingly rotates a lift plate cam and a feed plate. Plural swing arms are provided, each of which is in contact with the periphery of a one of the cams and is adapted to be actuated in conformity with the profiles thereof. A first lever shaft is provided on the frame and on which the swing arm for the lift cam is mounted and a second lever shaft is provided on the frame and on which the swing arm for the feed cam is mounted. An actuation system for transmitting the actuation of the swing arms to the feed bar is provided. The actuation system includes a lift arm connected to the swing arm operatively engaging the lift cam through the first lever shaft and a drive arm connected to the swing arm operatively engaging the feed cam through the second lever shaft. The lift arm and the drive arm are constructed so that both are coupled to the feed bar. The drive arm is movable vertically and laterally on a fulcrum on a slider movable up and down along a guide, to thereby move the lift arm and the drive arm to transmit the vertical and lateral movements to the feed bar.

BRIEF DESCRIPTION OF THE DRAWINGS

In order that the invention may be readily understood, preferred embodiments of this invention are described below, by way of example, with reference to the accompanying drawings, in which.

DETAILED DESCRIPTION

Figure 1:
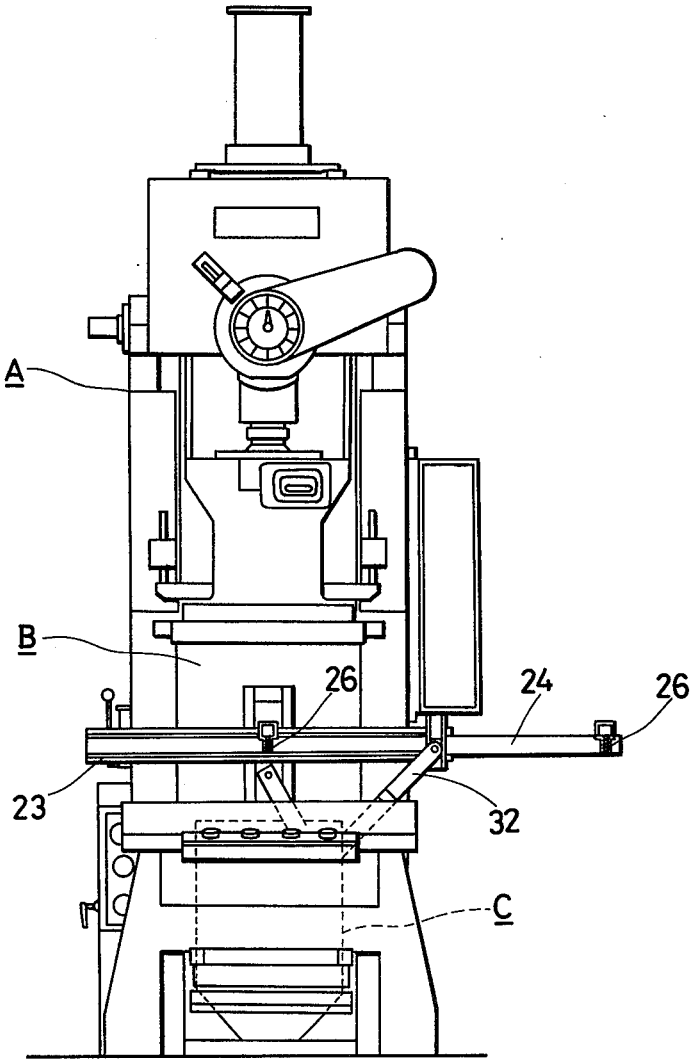
FIG. 1 and FIG. 2 are an elevational view and a partially cutaway side elevational view, respectively, of a pressing machine according to this invention.
Figure 2:
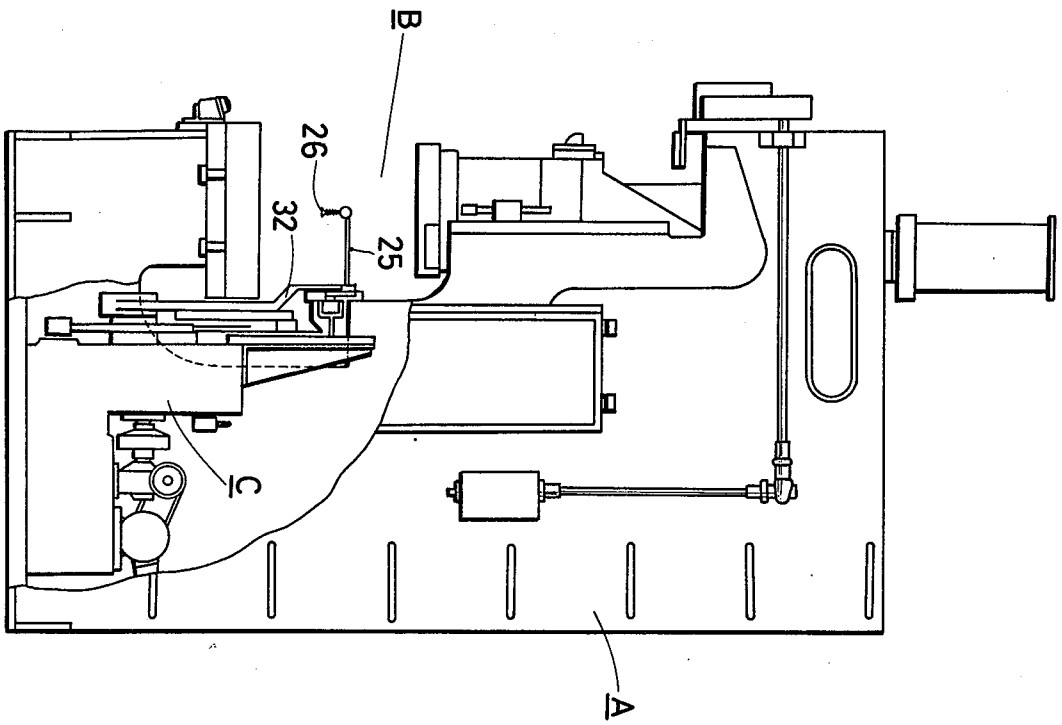

FIG. 1 and FIG. 2 illustrate an entire arrangement of the pressing machine according to the invention. The arrangement includes a C-frame press machine (A) of a single-acting crank type in which a robot (C) for loading a workpiece to be fabricated and unloading a fabricated product (hereinafter simply referred to as "robot") is built-in and disposed in a space enclosed by a frame behind a fabricating station (B), with chucks as described below protruding toward the front of the pressing machine (A), which robot constitutes the essential features of this invention.

The pressing machine per se is a known C-frame, single-acting or double-acting crank type of press, and hence no further explanation of it is deemed necessary.

Figure 3:
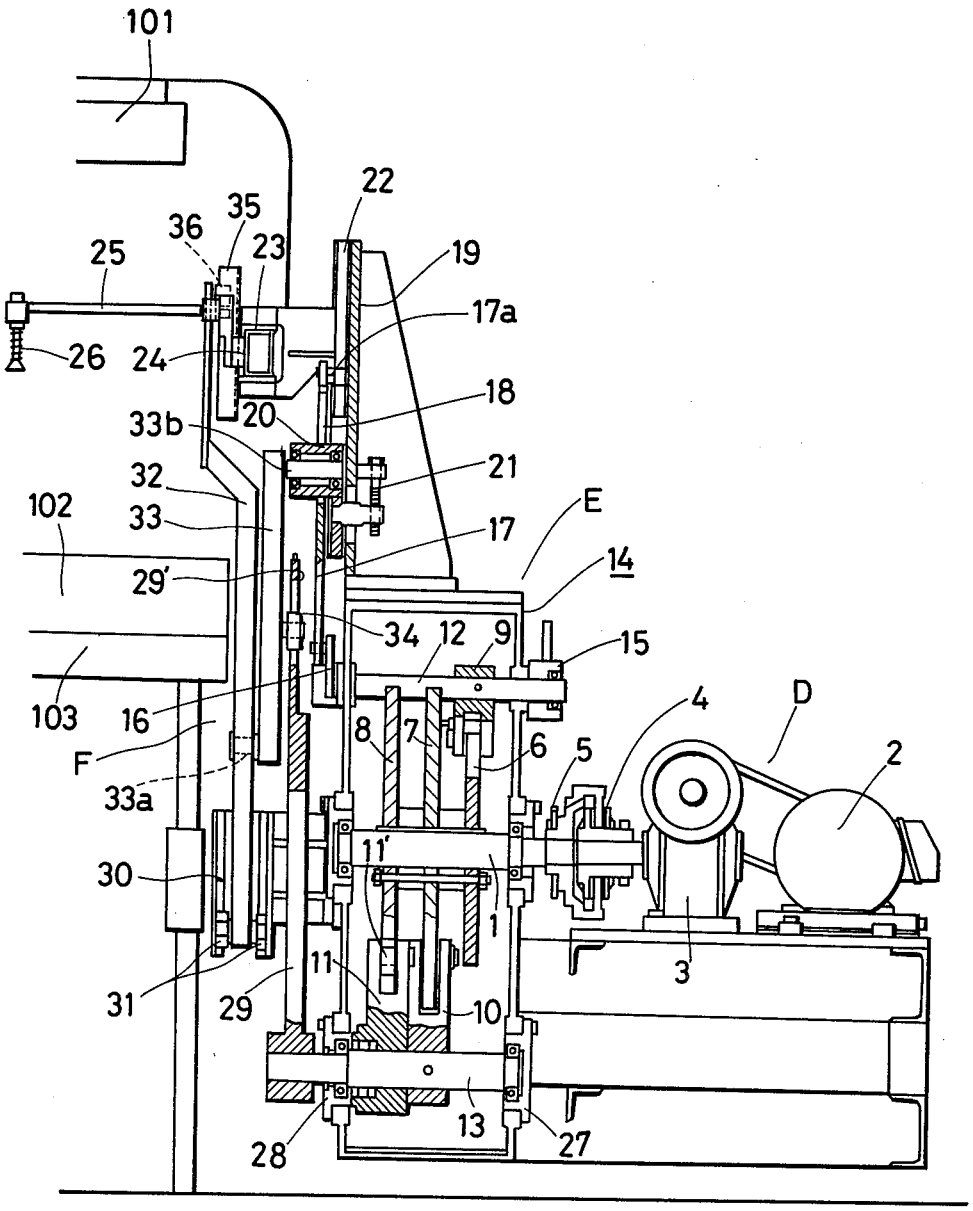
FIG. 3 and FIG. 4 are a partial side elevational view in cross-section and a partial elevational view in cross-section, respectively, showing a robot mechanism constituting essential elements of this invention.
Figure 4:
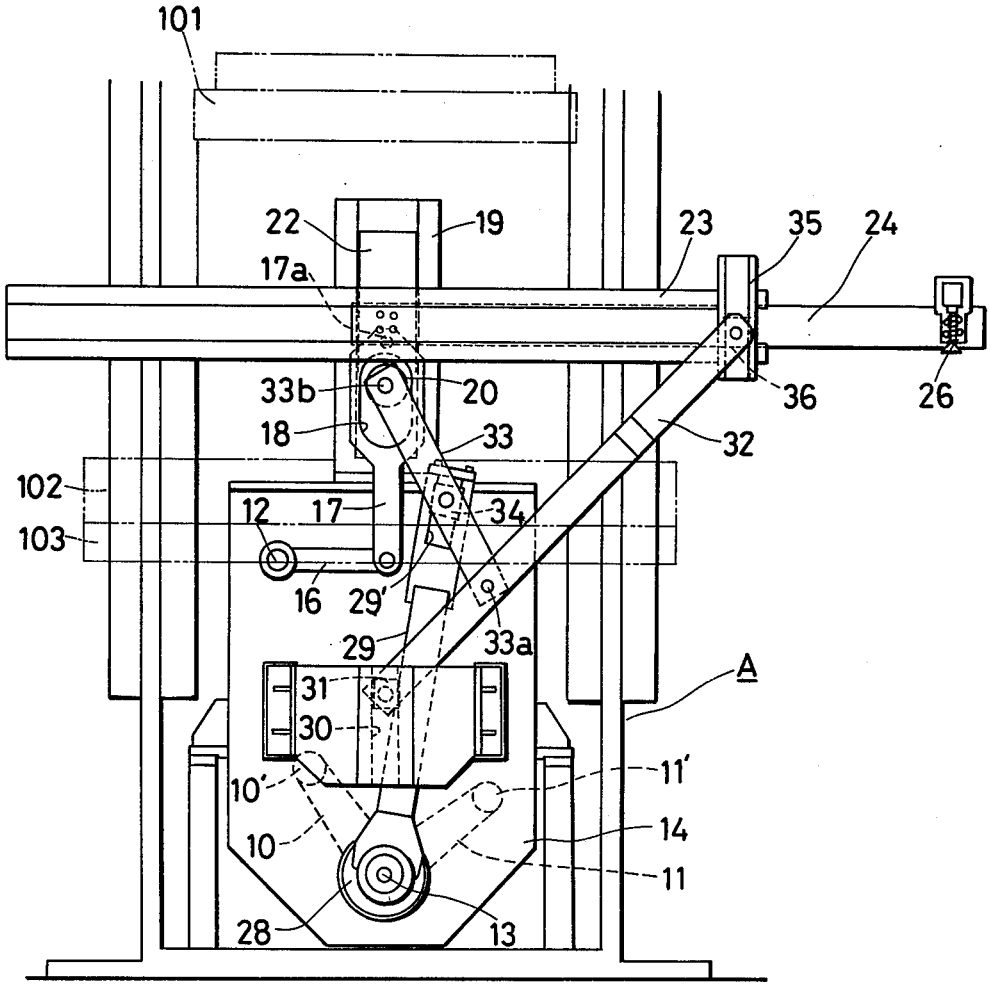

The robot to be built in the pressing machine comprises, as shown in FIG. 3 and FIG. 4, mainly a drive device (D) including a motor 2, a reduction gear 3, a torque limiter 4; an actuation-transmitting means (E) including one lift feed cam 6 and two platelike feed cams 7, 8 both mounted on a drive shaft 1 extending from the drive means (D) and swing arms 9, 10, 11 which have rollers 9', 10', 11' abutting on the peripheries of the respective cams and serve to transmit their actuations in compliance with the profiles of the cams 6, 7, 8; and an actuating system (F) for receiving the actuation of the actuation-transmitting means to transmit it to a feed bar and chucks each attached to the top of an arm protruding from the feed bar, as described below.

In the drive means (D), a sprocket 5 is provided in conjunction with the torque limiter 4, and is designed to move engaging with cams in a cam box (not shown) with a built-in limit switch being in operative relation to the press machine thereby to proceed with actuations of the robot.

Figure 8:
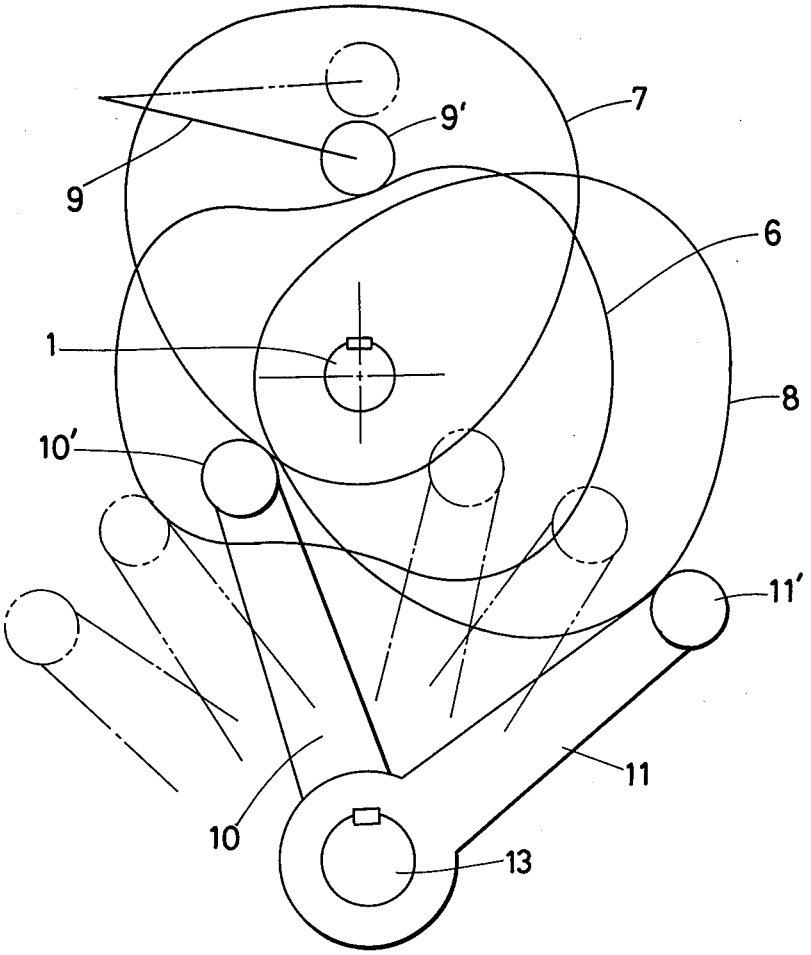
FIG. 8 is an illustration showing the actuation mode of the cams participating in the robot operation of a pressing machine according to this invention.

In the actuation-transmitting means (E), the one lift cam 6 and the two platelike feed cams 7, 8 both mounted on the drive shaft 1 are encased in a case 14 and are profiled as shown in FIG. 8. The two cams 7, 8 are positive motion cams of the same profile and are in a 90°-deviated position relation to one another. The roller 9' attached to the edge of the swing arm 9 is in contact with the periphery of the lift cam 6, and the rollers 10', 11' attached to the edges of the swing arms 10, 11 are in contact with the peripheries of the cams 7, 8, respectively. The swing arm 9 for the lift cam 6 is journaled in a metal bearing 15 secured to the case 14 at its one end and is mounted on a first lever shaft 12 coupled to a lift driving lever 16 at its other end. The swing arms 10, 11 for the feed cams 7,8 are mounted on and secured to a second lever shaft 13 which is supported by sealed bearing members 27, 28 and is coupled to a swing lever 29 which serves to transmit their actuations to a drive arm 32 for driving a feed bar 24.

The profile shapes of the cams 6, 7, 8 are determined so that the robot may conduct the loading and unloading operations in compliance with the work of the press machine and are designed based on a required cam diagram.

Referring to the actuating system (F), the lift-driving lever 16 linked to the first lever 12 serves to control the up-and-down movement of the feed bar 24 whereas the swing lever 29 linked to the second lever shaft 13 serves to impart up-and-down movement and right-and-left oscillation action to the feed bar 24.

The lift-driving lever 16 coupled to the first lever shaft 12 is in turn coupled to the lower end of a lift arm 17 which has an elongated channel 18 in the middle portion thereof. In the elongated channel 18 there is entered a fulcrum bearing case 20 which is attached to a bracket 19 provided resting on the case 14 so as to be capable of adjusting the vertical position with the aid of a stroke-regulating bolt 21. The upper end of the lift arm 17 is coupled to a lifter 22 through a pin 17*a*.

The lifter 22 is provided with a feed bar guide 23 protruding in front thereof, and the feed bar guide 23 receives the feed bar 24 therein so that the feed bar 24 may be slidable in the lateral direction. To the feed bar 24 there are attached a pair of arms 25 each provided with a material engaging chuck 26 at the top thereof through a suitable attachment seat, the pair of arms being laterally spaced apart a required distance from one another.

The chuck 26 may be, for example, a vacuum chuck as illustrated in the drawings or any other chuck such as a magnet chuck and is exchangeable appropriately to the feed bar 24.

On the other hand, the swing lever 29 connected to the second lever shaft 13 has, at the upper end thereof, an elongated hole 29' in which a slider 34 is provided which is coupled to an intermediate arm 33 through its shaft pin. The intermediate arm 33 is coupled, at its lower end, to the drive shaft 32 intermediate its ends by a pin 33*a*, and is coupled, at its upper end, to a fulcrum pin 33*b* which protrudes through the fulcrum bearing case 20 received in the lift arm 17.

The drive arm 32 linked to the intermediate arm 33 is, at its lower end, coupled slidably to a vertically movable guide 30 projecting from the case 14 by a slider 31, and is, at its upper end, coupled to a feed guide 35 which is provided in front of the feed bar 24 through a roller follower 36 so as to be slidable up and down.

The reference numeral 101 indicates a flange below a slide of the pressing machine. The reference numerals 102, 103 indicate a bolster and a table, respectively, of the pressing machine.

OPERATION

The operation of the robot mechanism as constructed above will now be described below.

When the drive shaft 1 is drivingly rotated by motor 2, the lift cam 6 and the platelike feed cams 7, 8 both mounted on the drive shaft are rotated as shown in FIG. 8. The roller 9' at the top of the swing arm 9 abuts on the lift cam 6 in conformity with its peripheral shape to effect an oscillation of the swing arm 9 up and down about the axis of the first lever shaft 12. With the revolution of the first lever shaft 12, the lift driving lever 16 and the lift arm 17 connected thereto are also moved up and down, to thereby slide the lifter 22 linked to the lift arm 17 at its top through the pin 17*a* up and down following the guide provided at the bracket 19. The up-and-down movement of the lift arm 17 will cause the feed bar guide 23 coupled integrally with the lifter 22 to also move up and down. Thus the feed bar 24 provided in the feed bar guide 23 is imparted on up-and-down movement.

In this way, the chucks 26 attached to the feed bar 24 can be moved up and down.

On the other hand, with the rotation of the cams 7, 8 mounted on the drive shaft 1 through a spacer in parallel to the lift cam 6, the swing arms 10, 11 having the rollers 10', 11' thereon abutting the outer peripheries of the cams 7, 8 are rotated integrally with the second lever shaft 13 to thereby oscillate the swing lever 29 right and left (FIG. 4).

Concurrently with the oscillation of the swing lever 29, the intermediate arm 33 connected to it oscillates about the axis of the fulcrum pin 33*b* at the top of it to thereby transmit the oscillation to the drive arm 32 connected to the lower end of the arm through the pin 33*a* intermediate the length thereof. At this time, the lower end of the drive arm 32 slides up and down within the vertically extending guide 30 whereas the upper end of it slides up and down through the roller follower 36 along the feed guide 35 attached to the feed bar 24.

In this way, the vertical movement of the lift arm 17 by means of the first lever shaft 12, and the vertical movement and the lateral oscillation of the drive arm 32 by means of the second lever shaft 13 are rendered synchronous with each other and are transmitted to the feed bar 24 thereby to move it laterally and vertically. Thus a series of operations of loading a workpiece to be fabricated and unloading a fabricated product are conducted with the chucks 26.

In the operations above it will be understood that the vertical and lateral movements of the feed bar 24 are not carried out concurrently, but the vertical movement begins subsequently to the lateral movement. That is, the operations of holding and loading a workpiece material and unloading and delivering a fabricated product are carried out at the end of the lateral movement, concurrently with which the feed bar 24 moves up and down to assist in the operations.

During the press fabricating, the chucks 26 wait at the midpoint of the lateral movement stroke lest they should retard the pressing work.

The length of the movement stroke can be varied, in case of necessity, by changing the position of the fulcrum pin 33*b* by reason of the regulation of a stroke-regulating bolt 21.

Figure 5:
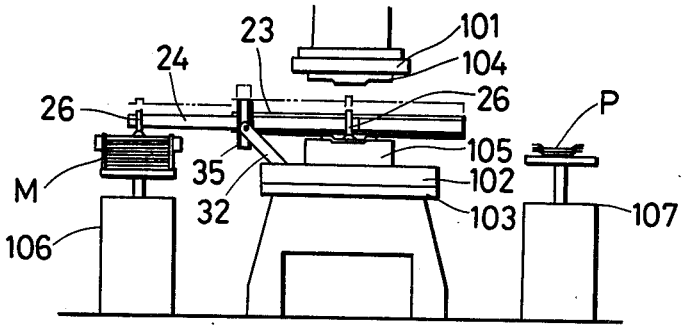
FIGS. 5 to 7 are illustrations showing operation steps of a pressing machine of this invention.
Figure 6:
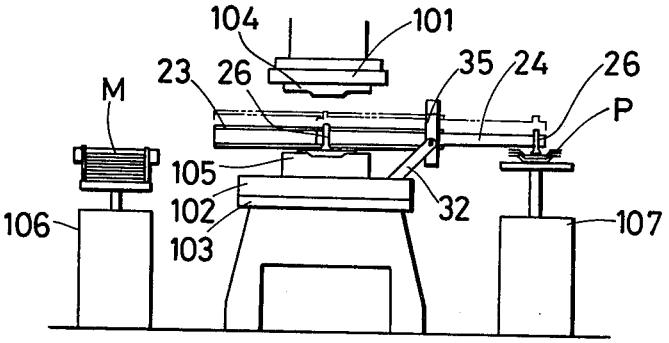
Figure 7:
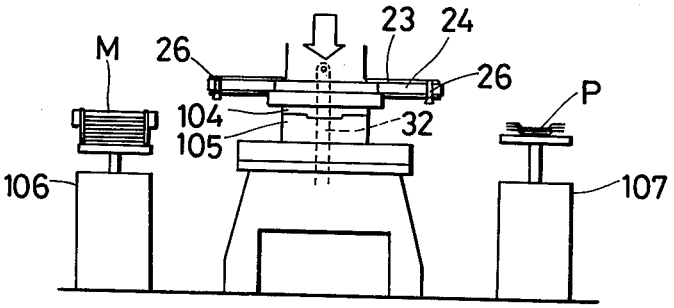

FIG. 5 to FIG. 7 show the stages of the press work carried out according to the operations described above.

In the stage of FIG. 5, the feed bar 24 moves up to its limit end of the left side of the drawing. The flange 101 below the slide of the pressing machine and the bolster 102 are not yet put in pressing position, and the upper press tool 104 and the lower press tool 105 are opened. The feed bar 24 descends and the chuck 26 at the left end is in the stage of gripping the next new workpiece material M to be fabricated from a workpieces station 106 while the chuck 26 at the right end is located on an as-fabricated product P and is about to unload it.

In this stage, as the lift cam and the platelike feed cams are rotated, the left-end chuck 26 is moved upwardly and then laterally to convey the workpiece material M to the pressing site while the fabricated product P is unloaded from the lower press tool 105 and conveyed to a fabricated products station 107 (see FIG. 6) by the similar movements to the former. A series of the upward movement and the lateral movement are as described above.

In the stage of FIG. 7, following the conveyance step, the new workpiece material M so conveyed and placed in the pressing site is now in a position to be pressed. That is, when the left-end chuck 26 conveys the new material M to the pressing site, it shifts slightly on the left side in compliance with the left-hand movement of the feed bar 24, concurrently with which the right-end chuck 26 after released from the product P also shifts slightly on the left side. Then the chucks 26 retreat from the working space of the press machine to their neutral positions. Thus, by the synchronous operation of the upper and lower press tools, pressing work is conducted without hindrance.

Thereafter, the drive shaft of the robot mechanism again revolves and the aforesaid working operations are repeated, whereby pressing work, loading of a new workpiece material and unloading of a fabricated product are carried out consecutively and automatically.

It is to be understood that the description thus far made is in relation to only one press machine.

In case where two or more press machines are arranged in alignment, the essential elements, i.e. the drive device, actuation-transmitting device and actuation system are arranged in a space behind one of the machines with the feed bar guide 23 and the feed bar 24 lengthened, whereby all of the machines can be worked simultaneously.

As described above, according to this invention, the essential elements of the robot mechanism can be assembled with the pressing machine by taking advantage of the space behind it. The robot per se is thus compact and can be easily built-in in the pressing machine. Therefore, the pressing machine can be installed in a greatly reduced space and can be made very compact. Furthermore, the front side of the apparatus is free of obstructions and offers no hindrance to personnel movement, so that press tools can be readily exchanged.

Since the robot is arranged to be intergral with the pressing machine behind its fabricating station, when the pressing machine is displaced, the robot system can be easily treated as if it constitutes a part of the machine, unlike a conventional robot system.

The robot system according to this invention can be attached to a conventional C-frame, single-acting or double-acting crank type of a pressing machine only by a slight reconstruction, so that it is very practical and useful.

Thus, according to the pressing machine of the present invention, not only are automation, energy-saving and reduction of working hours attainable, but also the installation space is reduced and accordingly, workshop ground can be efficiently utilized.

What we claim is:

1. A crank pressing machine, comprising:

a frame means and built-in robot means for loading a workpiece to be fabricated and unloading a fabricated product, said robot means being disposed in a space enclosed by said frame means behind a fabricating station, and a pair of spaced material engaging means provided on a feed bar extending across the front of said machine;

means supporting said feed bar for both vertical and lateral movement;

a driving means having a drive shaft;

a lift plate cam and a feed plate cam both mounted on said drive shaft of said driving means;

plural swing arms each of which is in contact with the periphery of a one of said cams and is adapted to be actuated in conformity with the profiles thereof;

a first lever shaft on said frame means and on which said swing arm for said lift cam is mounted and a second lever shaft on said frame means and on which said swing arm for said feed cam is mounted; and an actuation means for transmitting the actuation of said swing arms to said feed bar, said actuation means comprising a lift arm connected to said swing arm operatively engaging said lift cam through said first lever shaft and a drive arm connected to said swing arm operatively engaging said feed cam through said second lever shaft, said lift arm and said drive arm being constructed so that both are coupled to said feed bar;

vertical guide means provided on said frame means;

slider means slidably movably mounted in said guide means;

said lift arm being movable vertically; and said drive arm being movable vertically and laterally on a fulcrum on said slider means movable up and down along said vertical guide means, to thereby move said lift arm and said drive arm to transmit the vertical and lateral movements to said feed bar.

2. A pressing machine as set forth in claim 1, wherein one lift cam and two feed cams are mounted on said drive shaft, said two feed cams being positive motion cams of the same profile and deviated to one another by a phase of 90° whereby the peripheries of said feed cams are always in contact with rollers attached to the tops of said swing arms.

* * * * *